United States Patent [19]

Seebald

[11] 4,183,726

[45] Jan. 15, 1980

[54] PYRO-PROCESSING ROTARY KILN MIXING ROD

[76] Inventor: John W. Seebald, Route 9, York, Pa. 17404

[21] Appl. No.: 895,921

[22] Filed: Apr. 13, 1978

[51] Int. Cl.[2] ..... F27B 7/14

[52] U.S. Cl. ..... 432/13; 241/176; 241/183; 432/118

[58] Field of Search ..... 432/118, 14, 139, 13; 241/176, 183

[56] References Cited

U.S. PATENT DOCUMENTS

| | | | |
|---|---|---|---|
| 841,728 | 1/1907 | Sly | 241/176 |
| 2,557,528 | 6/1951 | Andrews | 241/183 X |
| 2,666,633 | 1/1954 | Bojner | 432/118 |
| 2,868,463 | 1/1959 | Hall | 241/184 |
| 3,030,091 | 4/1962 | Wicken et al. | 432/118 X |
| 3,169,016 | 2/1965 | Wicken et al. | 34/109 X |
| 3,442,497 | 5/1969 | Gantz | 432/118 |

FOREIGN PATENT DOCUMENTS

| | | | |
|---|---|---|---|
| 652291 | 10/1937 | Fed. Rep. of Germany | 432/118 |

*Primary Examiner*—John J. Camby
*Attorney, Agent, or Firm*—Ruth Moyerman

[57] ABSTRACT

A freely rotating rod or rods to be used in a high temperature rotary kiln, especially a cement kiln, to provide a combination of mixing and heat transfer is disclosed. The heat stable construction material and design of the rod permit heat in the kiln to be transferred more readily to the core of a feed material in a pyro-processing process, resulting in a more homogeneous end product.

The rod has a unique and critical tapered structure of gradually enlarging transverse cross section. The rod, because of its tapered design, may be placed in the kiln oriented with the smaller cross section lying uphill to offset its tendency to travel downhill with the moving feed. The rod then remains generally stationary in its section of the kiln. Alternately, the rod may be sized and oriented so that it will travel through the kiln with the feed if such is desired. In the latter example, the degree of taper determines the speed of travel. Finally, the rod may be sized and oriented to travel uphill against the flow of material.

10 Claims, 11 Drawing Figures

PYRO-PROCESSING ROTARY KILN MIXING ROD

BACKGROUND OF THE INVENTION

1. Field of the Invention

This invention relates to solid material mixing and more particularly to such mixing in combination with uniform heat transfer within rotary kilns.

2. Prior Art

Rotary kilns are well known in the art. They generally comprise an elongated, refractory lined cylinder adapted to be rotatably supported with the axis inclined so that various types of granular, particulate materials may, during processing, flow from the upper input end to the lower discharge end of the kiln. Materials commonly processed by pyro processing in rotary kilns include cement, lime, gypsum, etc. The moving materials are commonly heated by counter or concurrently flowing hot combustion gasses, and in the process of progressing through the kiln, the feed material is mixed by the action of the rotation of the kiln. Heat and mixing are critical to achieve the designed uniform, homogeneous end product. As may be appreciated, the form of mixing provided merely by the rotating kiln is highly inefficient, producing a core of non-uniform material. Through the years the state of the art has produced various devices to improve the mixing process and thus produce a more homogeneous product.

Inseparable from the mixing function is the related heat transfer problem. That is to say, a thorough heat transfer from the kiln gasses to the feed mix as well a mixing is also essential to the accomplishment of a high quality homogeneous end product.

There have been many proposals to aid heat transfer from kiln gasses to feed material. These include many well known mechanical devices such as refractory or metallic lifters, or heat exchangers. Another example involves the suspending of chains at a certain point within the kiln for the purpose of increasing mixing and heat transfer. U.S. Pat. No. 3,442,497 to Gantz is an example of a chain mixer. A more recently proposed solution in U.S. Pat. No. 3,030,091 and U.S. Pat. No. 3,169,016 to Wicken et al utilizes multi-chambers within the kiln to improve heat transfer.

Conversely, in the comminution art where the focus is particle crushing, not mixing, ball mills and cinder mills have been known to make use of bars to aid in the comminution process. U.S. Pat. No. 3,318,538 to Needham is an example of a rod utilized in the dry blending of polymers. U.S. Pat. No. 2,868,463 to Hall discloses a ball mill with load dispersion bar which freely rotates within the mill and is utilized to aid in mixing the grinding elements with the feed material. U.S. Pat. No. 841,728 to Sly discloses a horizontal cinder mill with a commutation rod within and extending the length of a rotary drum. In a wet process, U.S. Pat. No. 2,557,528 to Andrews discloses a scraping and tumbling finned member to aid in the continuous digestion of titaniferous material with sulfuric acid. Mixing of the feed is not a focus of these foregoing references and, in fact, segregation of the particles as they are crushed is more often the desired effect.

None of the foregoing address themselves to the exclusive problem of a mixing of a feed where the problem is in trying to disrupt a core of material within the feed itself. Furthermore, a mixing where no comminution is desired is likewise not the prior art focus. Also, none addresses the associated problems where the mixing process is inter-related with a heat transfer process and especially where the latter is a very high temperature operation. Moreover, the comminution art (where most processes are wet processes) does not address itself to the problem introduced where an elongated kiln is used or to a situation where a dry mix is continuously gravity fed and moved through elongated kilns which may exceed 700 feet in length. Certainly the comminution art does not commonly address itself to processes where the feed material is undergoing chemical and/or physical alteration in the course of its progress through the kiln.

Today, rotary kilns, particularly rotary cement kilns, produce a product which is poorly homogeneous because poor mixing and poor heat transfer impede the calcining operation. The end product is often non-homogeneous, poorly formed and has a material segregation which is most notable in that a core remains which is poorly mixed and requires additional heat to achieve proper reaction.

SUMMARY OF THE INVENTION

The foregoing prior art problems are solved by the device of this invention in which a dual purpose mixing or agitating rod combining unique material construction with unique configuration is provided. The rod in this invention is suitable for use in a pyroprocess in a rotary kiln especially a cement or lime kiln.

The rod of this invention is unique in material construction in that the rod is constructed of a heat conducting, high temperature stable material such as ceramic, metal or ceramic clad metal such that the rod itself is utilized to transfer heat to the core of the feed material (cement, for example).

The rod of this invention is unique in configuration in that, as a critical feature, the cross section of the bar varies in diameter, gradually increasing in size giving a tapered appearance to the rod. The rod or rods are placed within the length of the kiln in the intermediate, preheat, burning or discharge zone and several of the rods may be utilized in progression within the kiln.

To prevent the rod from traveling with the feed, the rod or rods must be placed within the kiln with their long dimension along the longitudinal axis of the kiln and with the smaller cross section portion lying uphill on the axis of rotation of the kiln. The rod, in use, will tumble as the kiln turns, breaking up and dispersing the core of the feed and creating a homogeneous feed. But, because the taper of the rod is critical and is predetermined to offset the tilt of the kiln, the rod or rods remain in place longitudinally and will not travel through the kiln with the mix. The rod is preferably fluted in design although other configurations such as circular, Y-shaped in cross section or others may be substituted. The rod of this invention is preferably constructed of materials stable at high temperatures, e.g. 2000 to 4000 degrees F.

Alternately, the rod may be reversed in orientation in the kiln with the smaller cross section downhill to cause the rod to travel with the feed. In this application, the degree of taper determines the rate of travel of the rod.

Dams may be used to block passage of the rod in those sections, if any, within the kiln when it is not desirable to have the rod travel.

DETAILED DESCRIPTION

The following detailed examples are directed to a pyroprocessing operation as practiced in a rotary kiln. The preferred embodiment which will also be described in detail below is directed toward a cement making process.

In a typical process for the manufacturing of cement, and as will be explained in more detail in reference to the drawings, the rotary kiln is typically at least 200 to 400 feet long and is inclined at an angle of about ½ inch to a foot from the horizontal to permit the feed to move through the kiln by gravity flow.

Since heat is involved, the barrel of the kiln is coated with a refractory lining as is well known in the art. Temperatures within a cement kiln vary. The kiln's various sections (zones) may range in a cement process from about 400° C. in the calcining zone to about 1400° C. in the burning zone and up to close to 1500° C. in the cooling zone. A gas flame, blowing countercurrent to the movement of the material through the kiln, commonly supplies the necessary heat.

Gravity, in combination with the rotation of the kiln, is relied upon to keep the feed moving through the kiln from the uphill introduction end to the downhill exit end of the kiln.

Rotary kilns are well known in the art and reference may be made, for example, to "The Rotary Cement Kiln", Chemical Publishing Company, Inc., 1972, "Cement Data-Book", by Duda, MacDonald & Evans Publishing, London, and other references on this subject.

In the example of a cement feed, the solid is a naturally impure limestone (calcium carbonate) with additionally from 15 to 40 percent silica, alumina and iron oxide. The feed is in the form of a powder in which typically 65 to 80 percent will pass a 200-mesh screen. The mix, although solid, has many fluid characteristics because of its powdery form.

Figure 1:
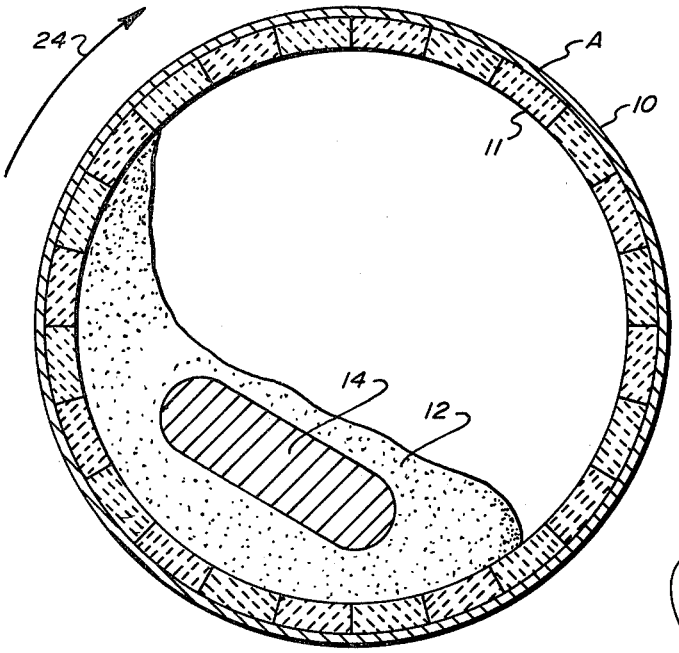
FIG.1 PRIOR ART
FIG. 1 shows a transverse cross section of a cement kiln, including a cross section of the feed material to show the core formed in the feed material during its passage through the kiln.

Referring now to the drawings wherein similar reference characters refer to similar parts, FIG. 1 represents a transverse cross section of a rotary kiln, generally A. FIG. 1 is included to better illustrate the prior art.

As the mix slides and falls through the kiln during the course of its processing, heat from the heated gasses is transferred to the feed material to effect the calcining chemical reaction. As a result of the sliding downhill movement of the feed material, there is a degree of segregation which occurs in the feed and the material becomes progressively more segregated and develops a poorly heated and mixed core. FIG. 1 illustrates this phenomena in which core 14 is shown developing within the feed mix 12. Ideally, the feed should emerge from the kiln totally homogeneous. In reality, segregation of the material gradually causing the formation of feed core 14 of poorly mixed material has, in fact, been the result.

I have discovered the means to eliminate this poor mixing of cement material within the kiln. The rod of this invention is designed, as will be more fully explained in reference to the drawings, to transfer necessary heat and agitation to the core of a feed material within a rotary kiln.

Furthermore, the rod has a unique and critical tapered structure of gradually enlarging transverse cross section. The rod, because of its tapered design, may be placed in the kiln oriented with the smaller cross section lying uphill to offset its tendency to travel downhill with the moving feed. The rod then remains generally stationary in its section of the kiln. Alternately, the rod may be designed and oriented so that it will travel through the kiln with the feed if such is desired. In the latter example, the degree of taper determines the speed of travel.

Figure 2:
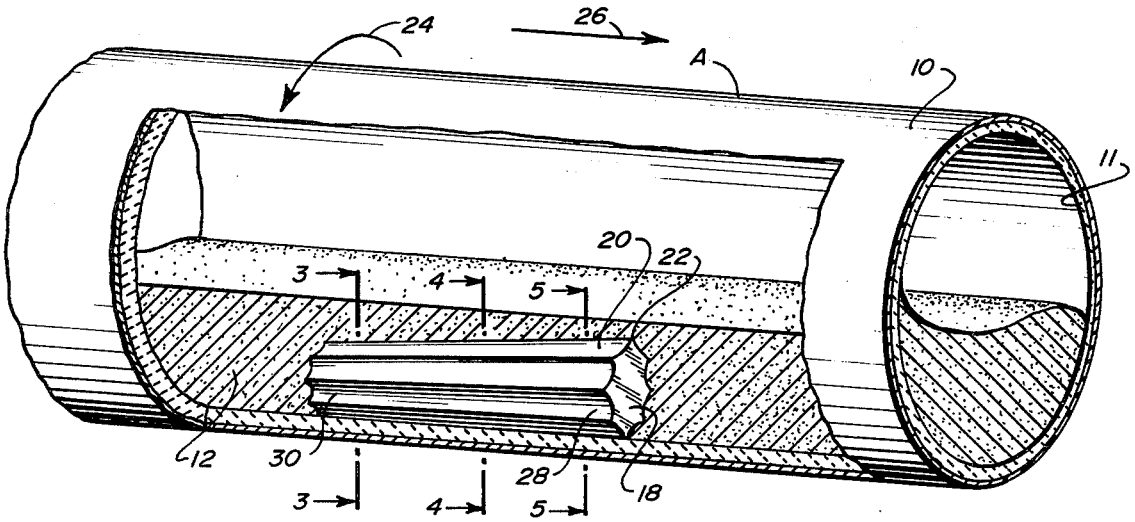
FIG. 2 shows an isometric of a section of a kiln with a cut away to show the rod of this invention placed such that forward downhill motion is prevented.

FIG. 2 illustrates an embodiment of this invention.

FIG. 2 shows an isometric of a section of a rotary kiln, indicated as A, including casing 10 and refractory lining 11. In FIG. 2, rotary kiln A is shown positioned on an angle inclined from the horizontal represented by 16. In cement kilns, an angle of incline of 2 to 6 percent is typical. FIG. 2 is also shown with a cutaway to better illustrate the rod of this invention. In FIG. 2, rod 18 is shown within feed mix 12. Rod 18 is this embodiment is shown as fluted in cross section including eight curved segments 20 and eight points 22.

Arrows 24 indicate the direction of rotation of kiln A.

As may be seen in FIG. 2, rod 18 is placed within kiln A with smaller cross section end 30 being positioned uphill from horizontal 16 and larger cross section end 28 being positioned downhill with respect to horizontal 16. In this position, e.g. the smaller tapered position being uphill, the rod will freely rotate within the kiln as the kiln turns but will not travel downhill with the feed. To calculate the exact degree of taper of the rod necessary to offset the downward tendency of its movement, it is necessary to know the speed of the kiln, the type of the material of the feed, e.g. its degree of fineness, the slope of the kiln and the weight of the rod. Knowing these aforementioned factors, the degree of taper of the rod to offset their effects may be made either empirically by conducting some simple experiments or by mathematical calculations.

It should be appreciated that if in fact it is desired for the rod to travel with the feed as it journeys through the kiln, the rod may simply be reversed in its orientation within the kiln so that large cross section end 28 is now uphill. In the latter instance, it should be appreciated that the degree of taper of the rod in combination with the aforementioned factors affecting downhill travel, allows the rod to be designed so as to travel at the same speed as the mix, or faster or slower.

The fluted design of the rod allows maximum transfer of heat in that a larger area of rod is available for contact with the feed material of the kiln.

Figure 3:
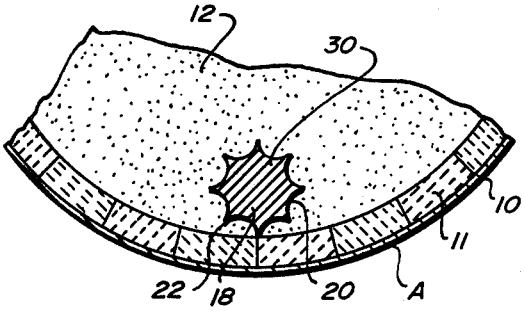
FIG. 3 shows a section taken on lines 3—3 of FIG. 2.
Figure 4:
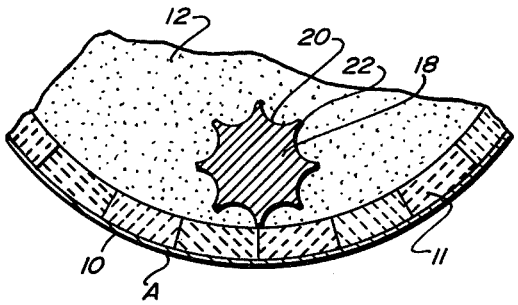
FIG. 4 shows a section taken on lines 4—4 of FIG. 2.
Figure 5:
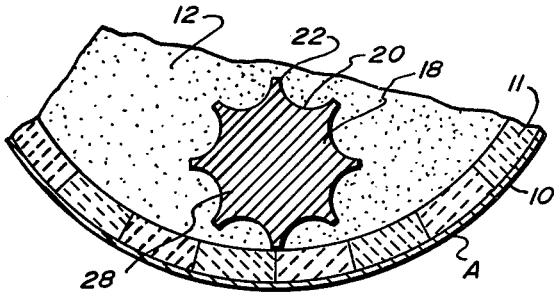
FIG. 5 shows a section taken on lines 5—5 of FIG. 2.

Referring now to FIGS. 3, 4 and 5, it may be seen more clearly the relationship of the taper of rod 18 to the height (or depth) of the feed material.

Naturally it should be understood that in as much as the rod and feed are constantly turning and tumbling as the kiln rotates, the positions illustrated by FIGS. 2, 3, 4 and 5 are only approximate and are given to illustrate that the device of this invention, in cross section, need not exceed the depth of the mix to achieve maximum blending and agitation.

FIG. 3 is a partial cross section taken on lines 3—3 of FIG. 2 and shows kiln A including casing 10 and refractory lining 11. Rod 18, shown in cross section, is shown resting against the inside wall of kiln A. It may be readily seen in FIG. 3 that the taper of the rod at this point is such that feed 12 covers the rod at approximately twice the depth of the rod.

FIG. 4, which is a cross section taken at approximately half the length of the rod (lines 4—4 of FIG. 2), indicates that although the rod is still totally covered by the mix in this position of repose, the depth of feed 12 above the rod has shrunk considerably.

Referring now to FIG. 5 which is a cross section taken along lines 5—5 of FIG. 2, one may see that in an ideal situation, the depth of the material versus the depth of the rod is such that rod 18 is barely covered by feed 12.

Figure 6:
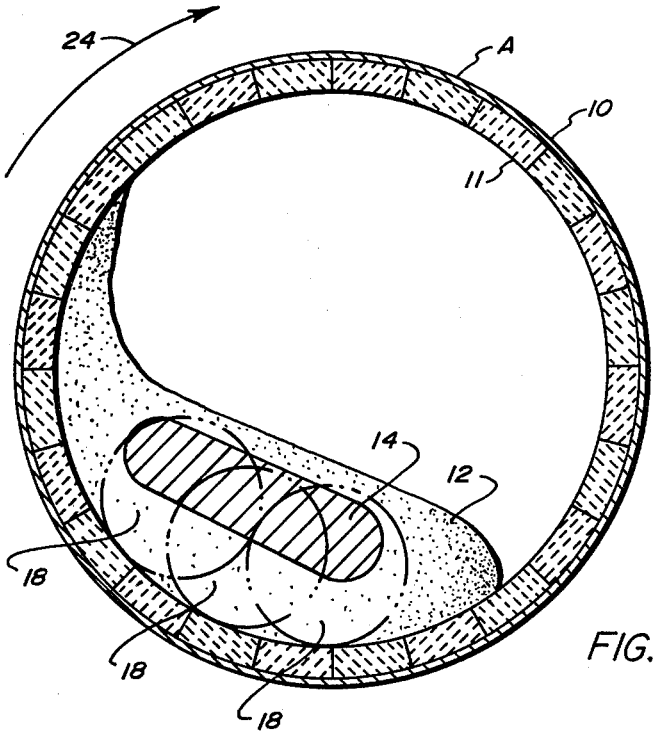
FIG. 6 shows a transverse cross section of a rotary kiln similar to that shown in FIG. 1, but in which the rod of this invention is shown in phantom in the positions it will occupy during the rotation of the kiln.

Referring now to FIG. 6, an embodiment similar to that of FIG. 1 is shown. However, FIG. 6 illustrates the use of the rod of this invention in its function of dispersing the segregated core of feed material. In FIG. 6, transverse cross section of kiln A is shown also including casing 10 and refractory lining 11. Feed 12 is shown including feed core 14 as previously described. Directional arrows 24 indicate the direction of rotation of the kiln.

However, in FIG. 6, rod 18, shown in phantom, is shown in the positions it will attain as the kiln rotates. Thus it may be readily seen that the rotation of the kiln will cause the gradual upward rolling of rod 18 causing it to turn, progressing through the feed mix as the feed mix itself turns. Feed core 14 will thus be dispersed while it is in the formation stage and will, in fact, never reach the degree of formation as illustrated in FIG. 6. In FIG. 6, rod 18 is shown as circular in cross section to better visually illustrate its function.

Figure 7:
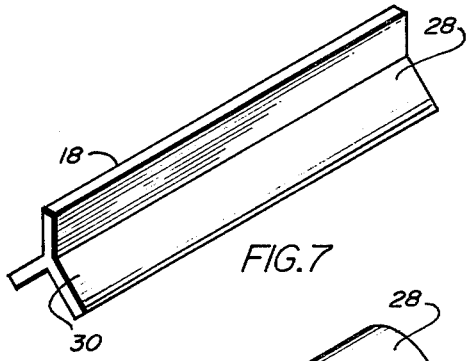
FIG. 7 is an isometric showing the rod of this invention with a Y-shaped cross section.

Referring now to FIG. 7, a variation of the device of this invention is shown in which rod 18 is approximately Y-shaped in cross section.

Figure 8:
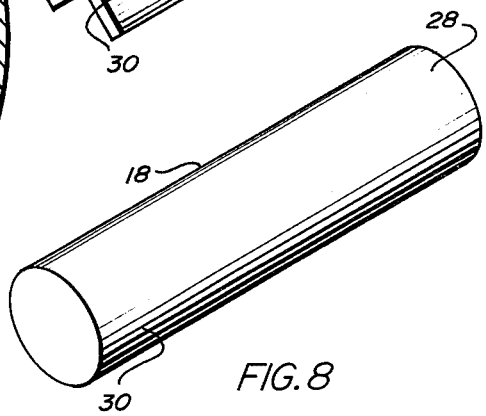
FIG. 8 shows an alternative embodiment of the rod of this invention in which the rod is circular in cross section.

FIG. 8 illustrates another variation of the rod of this invention in which the rod in transverse cross section is circular in configuration.

Figure 9:
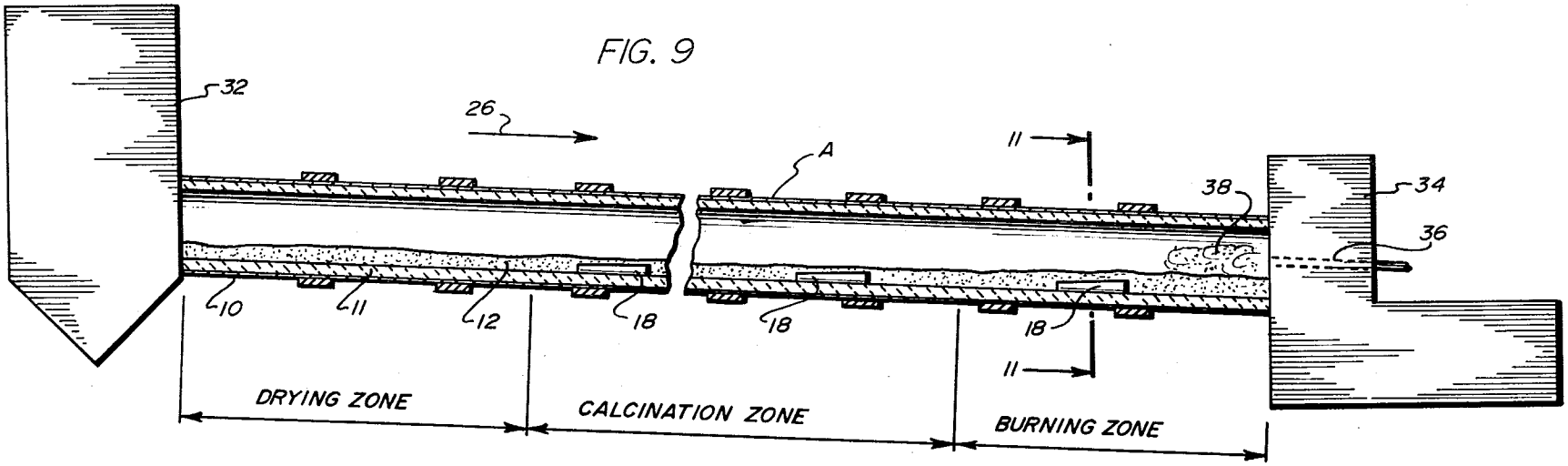
FIG. 9 shows a diagram of the cement kiln operation including an illustration of the use of several of the rods of this invention in a single kiln.

Referring now to FIG. 9, a total kiln operation is shown diagrammatically. In FIG. 9, feeder hopper 32 supplies feed material to kiln A. Material travels through kiln A from the dehydration or drying zone through the calcining zone, clinkerization or burning zone and finally through the cooling zone, not shown. Firing hood 34, containing gas jet 36, supplies heat to the kiln through flame 38.

FIG. 9 illustrates the use of several rods of this invention in a single kiln operation. In FIG. 9, three rods 18 are shown as being utilized in the overall process. This number is not critical but simply illustrative of the fact that one or more rods may be used if such is desired.

Figure 10:
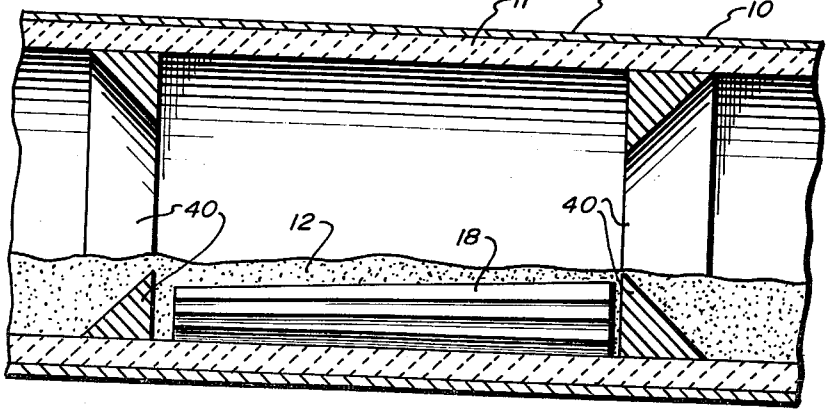
FIG. 10 shows an embodiment in which the device of this invention is used with a dam.

FIG. 10 illustrates yet another embodiment of this invention wherein, if it is desired for safety or convenience sake, dams 40 may be installed within kiln A so as to provide an extra protection against the inadvertent movement of rod 18 from its zone or station within the kiln.

Figure 11:
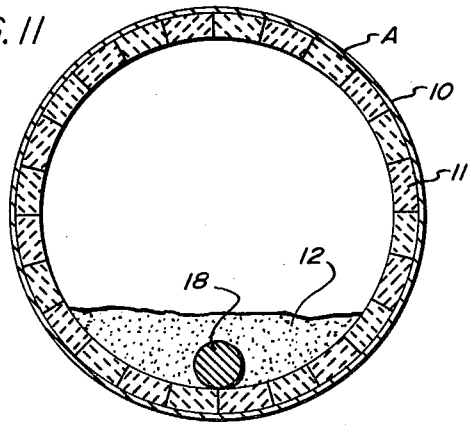
FIG. 11 shows a cross section taken on lines 11—11 of FIG. 9.

FIG. 11 shows a section taken on lines 11—11 of FIG. 9 and further shows the rod of this invention when placed in the burning zone of a rotary kiln A. In some applications a coating build-up occurs and may be such as to limit the use of the rod in this area of the kiln.

There are many variations which may be practiced within the scope of this invention. As has been pointed out, the taper and weight of the rod are critical for the particular operation for which they are intended. However, taking into account the overall weight of the rod, it is not critical that the rod be of any particular relationship of its cross section to its length. That is to say, that while FIGS. 2 through 5 show the ideal situation of the feed just covering the top of the rod at its widest portion, this relationship is not critical. The rod of this invention may be constructed of ceramic or metal or any other materials suitable to withstand the high temperature inherent in a pyro-processing operation.

Furthermore, although three different configural cross sections have been shown in the rod's design, these are not meant to limit the design of the rod. Any configuration which performs the function is satisfactory. Furthermore, although the rod of this invention has been illustrated with a uniform configural cross section throughout the individual rod, this is not intended to be a limitation of the invention. It is possible for the rod, for example, to be circular in cross section during part of its length and fluted or another design in other parts of the length of the same rod.

While the foregoing examples have been directed to a rotary cement kiln, the rod of this invention is equally satisfactory for other pyro-processing operations including portland cement, natural cement, lime, gypsum, heat expanded aggregates such as shale, clay and vermiculite including both wet and dry processes.

Having thus illustrated my invention, it is not intended that the foregoing be a limitation, but rather that the invention be limited only by reasonable interpretation of the claims.

1. In a high temperature kiln of generally circular cross-section which rotates around its longitudinal axis, having a plurality of zones the temperature of which may be as high as about 4000° F., the feed end thereof being elevated with respect to the discharge end thereof, and wherein there is a tendency during the pyro-processing occurring therein to form a longitudinally extending core of material which has not been properly mixed or heat treated, a mixing and heat-transfer device comprising:

a longitudinally extending rod of heat resistant, conductive material which, by virtue of its weight and configuration, follows a pre-determined travel path within said rotating kiln—said path, in its transverse direction always continually passing through the situs of said longitudinally extending core and, in its longitudinal direction, ranging from downhill travel in the feed direction, through zero longitudinal displacement, to travel uphill counter to the feed direction;

said configuration including an increasing cross-sectional area from one end to the other, the larger cross section facing toward the discharge end of the kiln when the predetermined longitudinal travel path ranges from zero displacement to travel uphill, said configuration, being further, for any given weight of rod, a mathematical function of parameters including the rotational speed of the kiln, its slope and the type of material being processed;

whereby heat is transferred via said rod to said core and material at said core situs is mixed.

2. The device according to claim 1 in which said kiln includes dams delineating transverse limits of one or more of said zones and prevents passage of said rod from one zone to another.

3. The device according to claim 1 wherein said rod is generally circular in cross section.

4. The device according to claim 1 wherein said rod is fluted in cross section.

5. The device according to claim 1 wherein said rod is generally Y-shaped in cross section.

6. The device according to claim 1 wherein a single rod is utilized.

7. The device according to claim 1 wherein a plurality of rods is utilized.

8. The device according to claim 1 wherein a plurality of rods is utilized in series each with the other.

9. The device according to claim 1 wherein the rotary kiln is a cement producing kiln.

10. A method of mixing material in a high temperature kiln comprising:

(a) providing a kiln of generally circular cross-section which rotates around its longitudinal axis, having a plurality of zones the temperature of which may be as high as about 4000° F., the feed end thereof being elevated with respect to the discharge end thereof, and wherein there is a tendency during the pyroprocessing occurring therein to form a longitudinally extending core of material which has not been properly mixed or heat treated;

(b) introducing a feed material into said kiln feed end;

(c) providing a longitudinally extending rod of heat resistant conductive material which, by virtue of its weight and configuration when longitudinally located within said rotating kiln follows a pre-determined travel path—said path, in its transverse direction always concontinually passing through the situs of said longitudinally extending feed material core and, in its longitudinal direction, ranging from downhill travel in the feed direction, through zero longitudinal displacement, to travel uphill counter to the feed direction;

said configuration including an increasing cross-sectional area from one end to the other, the larger cross section facing toward the discharge end of the kiln when the predetermined longitudinal travel path ranges from zero displacement to travel uphill, said configuration, being further, for any given weight of rod, a mathematical function of parameters including the rotational speed of the kiln, its slope and the type of material being processed;

whereby heat is transferred via said rod to said potential core and material at said core situs is mixed and dispersed.

* * * * *